United States Patent [19]

Hayes et al.

[11] Patent Number: 4,890,848

[45] Date of Patent: Jan. 2, 1990

[54] RACKET HANDLE AND DESICCANT DISPENSER

[76] Inventors: Wilmer G. Hayes, 3500 Burlingame Dr.; Gina K. Hayes, 3500 Burlingame Rd., both of Topeka, Kans. 66611

[21] Appl. No.: 270,617

[22] Filed: Nov. 14, 1988

[51] Int. Cl.[4] ..... A63B 49/00

[52] U.S. Cl. ..... 273/73 J; 273/75; 222/470

[58] Field of Search ..... 273/67 DA, 72 R, 73 R, 273/73 J, 75, 81 R, 162 R, 162 F, 17, 18, 19; 222/470, 478

[56] References Cited

U.S. PATENT DOCUMENTS

| | | | |
|---|---|---|---|
| 879,477 | 2/1908 | Krüger | 273/73 J |
| 1,045,071 | 11/1912 | Oldenbusch | 273/162 R |
| 1,380,973 | 6/1921 | Kelsea | 222/470 |
| 1,563,352 | 12/1925 | Fisher | 273/73 J |
| 1,687,120 | 10/1928 | Blanchard | 222/470 |
| 3,645,008 | 2/1972 | Delsack | 273/73 J |
| 4,108,436 | 8/1978 | Masi | 273/75 |
| 4,139,195 | 2/1979 | Dreesen et al. | 273/75 |
| 4,533,139 | 8/1985 | Goldin | 273/73 J |

FOREIGN PATENT DOCUMENTS

| | | | |
|---|---|---|---|
| 2944609 | 5/1981 | Fed. Rep. of Germany | 273/75 |
| 3310498 | 9/1984 | Fed. Rep. of Germany | 273/73 J |
| 3706554 | 9/1988 | Fed. Rep. of Germany | 273/73 J |
| 326877 | 6/1935 | Italy | 273/73 J |
| 655663 | 5/1986 | Switzerland | 273/75 |
| 407983 | 3/1934 | United Kingdom | 273/73 J |

*Primary Examiner*—Edward M. Coven
*Assistant Examiner*—William E. Stoll
*Attorney, Agent, or Firm*—Leon Gilden

[57] ABSTRACT

A racket handle and dispenser is set forth wherein a magazine is contained within an uppermost portion of the handle for containment of a desiccant powder wherein a spring-biased first plunger adjacent the magazine dispenses a portion of desiccant powder about an uppermost portion of the handle wherein an aligned underlying second chamber utilizes a second spring-biased plunger and associated valve to dispense desiccant powder selectively to a lowermost portion of the handle.

10 Claims, 1 Drawing Sheet

10
11
2
12
3
G 17a
18
19
17
17b
13a
13b
16
13
12
20a
20
21
14
14a
5
5
23
22
16a
G 16
13
20a
20
21
14
14a
16a
23
22
25a
24
27a
26
27
15
15a
29
28
30b
30
30a
25

16a
14a
22
23
14a
14a
23
14a
23

13
16
12

RACKET HANDLE AND DESICCANT DISPENSER

BACKGROUND OF THE INVENTION

1. Field of the Invention

The field of invention relates to sporting equipment, and more particularly pertains to a new and improved racket handle and desiccant dispenser utilized in association with rackets of various sporting games to dispense a selective portion of desiccant powder about selective portions of the handle.

2. Description of the Prior Art

The use of desiccant powder to absorb moisture during the playing of a sporting event is known in the prior art. Prior art devices have been relatively complex organizations and have been limited in the manner in which a desiccant powder may be selectively applied to various portions of an associated handle. For example, U.S. Pat. No. 879,477 to Kruger sets forth an early application of incorporating associating apparatus into a tennis racket handle by counter-boring a tennis racket handle and inserting a weighted medium therewithin to assist in the swing of the racket by an individual.

U.S. Pat. No. 1,045,071 to Oldenbusch sets forth a dispenser positioned within the handle of an associated reflective mirror wherein an associated valve positioned within an underlying portion of the handle enables discharge of a toiletry powder therefrom as desired by an individual.

U.S. Pat. No. 1,563,352 to Fisher sets forth a tennis racket wherein the racket handle is provided with a hollow chamber to contain powder therein wherein a slidably removable disk positioned over a bore within a side of the handle enables selective removal of powder in the central chamber. As may be appreciated, this is a rather rudimentary form of powder dispensing, as opposed to the instant invention. U.S. Pat. No. 3,645,008 to Delsack sets forth a means for discharging a desiccant chamber interiorly of a handle wherein a central chamber is provided with passageways leading to the handle surface to accept desiccant powder from the central chamber. The Delsack patent fails to set forth the selective application of the associated powder from a plurality of chambers as set forth by the instant invention.

U.S. Pat. No. 4,533,139 to Goldin sets forth a tennis racket handle wherein a cooling medium, such as a pressurized carbon dioxide gas, is positioned within the handle wherein passageways leading to the handle minimize perspiration and slippage due to the cooling effect of the medium positioned within the handle.

As such, it may be appreciated that there is a continuing need for a new and improved racket handle and desiccant dispenser which addresses both the problems of effectiveness and ease of use, and in this respect, the present invention substantially fulfills this need.

SUMMARY OF THE INVENTION

In view of the foregoing disadvantages inherent in the known types of desiccant dispensers now present in the prior art, the present invention provides a racket handle and desiccant dispenser wherein a plurality of manually reciprocatable and spring-biased valves are axially aligned within a racket handle for selective dispensing of desiccant powder selectively over discrete portions of a racket handle. As such, the general purpose of the present invention, which will be described subsequently in greater detail, is to provide a new and improved racket handle and desiccant dispenser which has all the advantages of the prior art desiccant dispensers and none of the disadvantages.

To attain this, the present invention comprises a racket handle formed with a centrally aligned chamber. The chamber has formed therein an upper magazine for securement of desiccant powder therein with an axially extending rod through the magazine and formed with a spherical insert to cooperate with a valve seat to be selectively disengaged from the seat to enable desiccant powder to travel from the magazine to an underlying first chamber. A second chamber is axially aligned underlying the first chamber and formed with a guide bearing axially aligned thereunder to provide support and guidance for respective valve rods of the first and second chambers extending outwardly of the handle on either end thereof and provided with respective valves to enable desiccant powder to be dispensed about upper and lower surfaces selectively of the racket handle.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and system for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved racket handle and desiccant dispenser which has all the advantages of the prior art desiccant dispensers and none of the disadvantages.

It is another object of the present invention to provide a new and improved racket handle and desiccant dispenser which may be easily and efficiently manufactured and marketed.

It is a further object of the present invention to provide a new and improved racket handle and desiccant dispenser which is of a durable and reliable construction.

An even further object of the present invention is to provide a new and improved racket handle and desiccant dispenser which is susceptible of a low cost of manufacture with regard to both materials and labor, and which accordingly is then susceptible of low prices of sale to the consuming public, thereby making such racket handle and desiccant dispensers economically available to the buying public.

Still yet another object of the present invention is to provide a new and improved racket handle and desiccant dispenser which provides in the apparatuses and methods of the prior art some of the advantages thereof, while simultaneously overcoming some of the disadvantages normally associated therewith.

Still another object of the present invention is to provide a new and improved racket handle and desiccant dispenser wherein a plurality of axially aligned valves underlie a magazine formed with a racket handle to selectively apply a desiccant powder over discrete portions of a racket handle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2, 3, 4, 5:
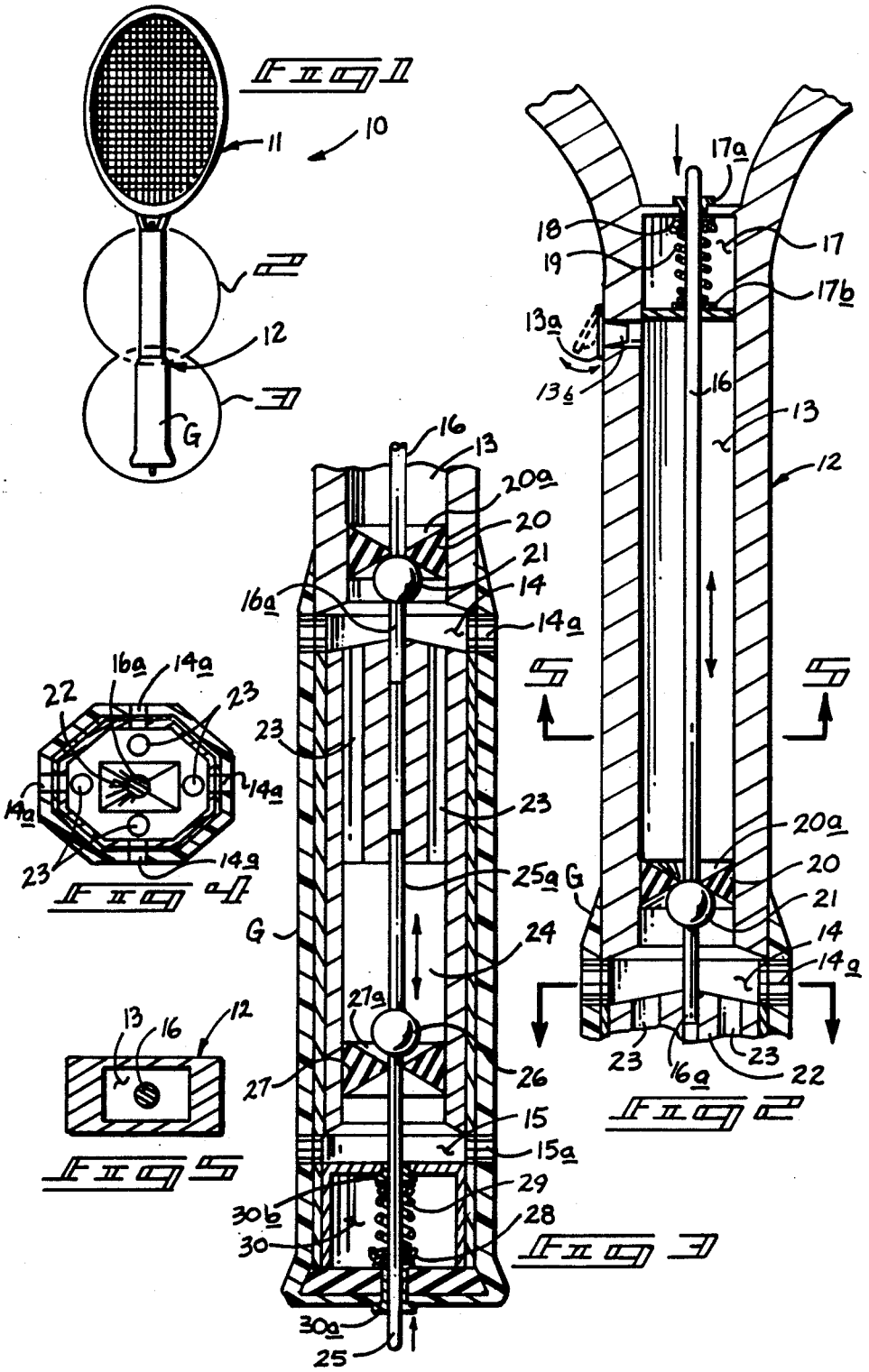
FIG. 1 is an orthographic view of a typical racket, as utilized by the instant invention.
FIG. 2 is a cross-sectional view of the racket handle indicated in FIG. 1.
FIG. 3 is an orthographic cross-sectional view of the racket handle, as indicated in FIG. 1.
FIG. 4 is an orthographic view taken along the lines 4—4 of FIG. 2 in the direction indicated by the arrows.
FIG. 5 is an orthographic view taken along the lines 5—5 of FIG. 2 in the direction indicated by the arrows.

With reference now to the drawings, and in particular to FIGS. 1 to 5 thereof, a new and improved racket handle and desiccant dispenser embodying the principles and concepts of the present invention and generally designated by the reference numeral 10 will be described.

More specifically, it will be noted that the racket handle and desiccant dispenser 10 essentially comprises a conventional racket head 11 and an associated downwardly depending aligned handle 12. The handle 12 is formed with a top compartment 17 overlying an elongate magazine cavity 13 with an underlying first chamber 14. The top compartment 17, the magazine cabinet 13, and the first chamber 14 contain an axially centered first plunger rod 16 reciprocatably therethrough. The top compartment 17 houses a spring 19 with a cup-shaped follower 18 at an uppermost portion of the spring with the plunger rod 16 extending through orthogonal walls containing respective outer and inner seals 17*a* and 17*b* to prevent contamination and intrusion of the first chamber 14 and provide a barrier to prevent contamination of a desiccant powder positioned within the magazine cavity 13. A pivoting plug seal 13*a* of preferably resilient construction enables access to the interior of the magazine cavity 13 by a fill conduit 13*b*. The cup-shaped spring follower 18 is fixedly secured to the plunger rod 16 whereupon depressing of the plunger rod 16 carries the spring follower 18 therealong and compresses spring 19 whereupon release of the plunger rod 16 biases the plunger rod 16 to its initial position, as illustrated in FIG. 2 for example.

A valve, including a first diaphragm valve seat 20 formed of a resilient web material with the central aperture therethrough, defines a lowermost end wall of the magazine cavity 13 and includes a first spherical plug 21 fixedly secured to the plunger rod 16 whereupon depressing of the plunger rod 16 against the bias of spring 19 vertically displaces the spherical plug 21 from its seat on the diaphragm valve seat 20 and allows a desiccant powder to travel and be directed through by a conical directed surface 20*a* at an uppermost portion of the valve seat 20 into the first chamber 14. The first chamber 14 includes plural pairs of aligned first chamber passageways 14*a* (as illustrated in FIG. 4) and thereby distributes a desiccant powder along an uppermost surface of the grip portion "G" of the handle 12.

The plunger rod 16 includes a first plunger rod extension 16*a* depending and extending axially aligned with the plunger rod 16 and beyond the first spherical plug 21 and directed into an axially aligned bore of a support bearing 22 positioned within the central cavity 24 within the handle 12. The central cavity 24 includes plural pairs of conduits 23 surroundingly and axially displaced relative to the support bearing 22 to enable desiccant powder to be directed from the magazine cavity 13 through the first chamber 14, then through the conduits 23 and into the central cavity 24 whereupon a second plunger rod 25 formed with a second plunger rod extension 25*a* extends into a lowermost portion of the bore of the support bearing 22. A second spherical plug 26 is fixedly secured between the second plunger rod 25 and the extension 25*a* and is normally biased upon and overlies a central opening within a second diaphragm valve seat 27. A conical directing surface 27*a* formed at an uppermost portion of the diaphragm valve seat 27 directs the desiccant powder therethrough upon depressing of the plunger rod 25 extending outwardly of the handle 12 and into a second chamber 15. Like the first chamber 14, the second chamber 15 includes a plurality of aligned second chamber passageways 15*a* to direct desiccant powder about a lowermost portion of the handle 12. In this manner, desiccant powder is selectively directed onto selective portions of the handle 12 dependent on user need.

Similarly, a lower spring 29 includes a cup-shaped lower spring follower 28 fixedly secured to the second plunger rod 25 to return the plunger rod 25 to its original position upon release thereof. Outer and inner seals 30*a* and 30*b* respectively seal the orthogonally enclosing walls of the lower compartment 30 from contamination to ensure longevity of operation of the instant invention.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A racket handle and desiccant dispenser apparatus for use in combination with a handle and an elongate downwardly extending handle, said apparatus comprising, an elongate magazine cavity formed in said handle for containment of desiccant powder;

said magazine cavity including a removable filling means allowing filling of said magazine cavity, and a first chamber underlying the magazine cavity, a first resiliently biased plunger axially aligned with said magazine cavity with a first valve plug displaceable upon displacement of said first plunger to allow desiccant powder within said magazine cavity to flow through a first valve into an underlying first chamber, said first chamber includes a plurality of first chamber passageways enabling flow of that same powder from interiorly of said chamber to an upper exterior portion of said handle, and a central cavity in said handle underlying said first chamber, a second chamber underlying said central cavity, and a second valve defining a lowermost wall of said central cavity including a second valve plug displaceable from said valve by a second biased plunger axially aligned with said first plunger to enable flow of desiccant powder from said central cavity to said second chamber, and means between said first chamber and said central cavity to enable flow of desiccant powder from said first chamber to said central cavity, and said second chamber including a plurality of second chamber passageways to allow flow from said second chamber to a lower exterior portion of said handle displaced from said upper exterior portion of said handle.

2. A racket handle and desiccant dispenser apparatus as set forth in claim 1 wherein means for filling said magazine cavity includes a selectively positionable resilient plug selectively positionable within a through-extending opening within said handle enabling selected filling of said magazine cavity.

3. A racket handle and desiccant dispenser apparatus as set forth in claim 2 wherein said first valve defines a lowermost containment wall of said magazine cavity, and said first valve further includes a conical directing surface to direct desiccant powder from said magazine cavity through said valve and into said first chamber.

4. A racket handle and desiccant dispenser apparatus as set forth in claim 3 wherein said first plunger includes a first plunger extension beyond said first valve plug and into a support bearing axially aligned with said first plunger to slidingly guide and maintain alignment of said first plunger with respect to said first valve plug and said first valve.

5. A racket handle and desiccant dispenser apparatus as set forth in claim 4 wherein a top compartment is positioned overlying said magazine cavity and axially aligned therewith includes a spring positioned about said first plunger with a first follower fixedly secured to said plunger to depress said spring upon displacement of said first plunger and bias said plunger to an initial position to secure said first valve plug to said first valve.

6. A racket handle and desiccant dispenser apparatus as set forth in claim 5 wherein said second plunger is fixedly secured and axially aligned with said second valve plug, and further including a second plunger extension extending beyond said valve plug and slidably aligned within said support bearing.

7. A racket handle and desiccant dispenser apparatus as set forth in claim 6 wherein said means for enabling flow of desiccant powder from said first chamber into said central cavity includes a plurality of elongate passageways communicating with said first chamber and said central cavity and in surrounding relationship to said support bearing.

8. A racket handle and desiccant dispenser apparatus as set forth in claim 7 wherein said second chamber is axially aligned with said central cavity and wherein said central cavity is axially aligned with said first chamber and said magazine cavity.

9. A racket handle and desiccant dispenser apparatus as set forth in claim 8 further including a lower compartment axially aligned with said second chamber including a spring positioned about said second plunger including a spring follower integrally secured to said second plunger to displace said spring upon axial displacement of said second plunger to bias said spring to an initial position to secure said second valve plug to said second valve.

10. A racket handle and desiccant dispenser apparatus as set forth in claim 9 wherein said top compartment and said lower compartment each include spaced walls to secure said spring therebetween and further including seals positioned within said spaced walls to slidingly accept the respective first and second plungers therethrough and prevent contaminants from entering said top and lower compartments.

* * * * *